US009198510B2

(12) United States Patent
Moritz et al.

(10) Patent No.: US 9,198,510 B2
(45) Date of Patent: Dec. 1, 2015

(54) LOCKER SHELF ASSEMBLY KIT WITH EXTENSION SHELVES, LOCKER SHELF ASSEMBLY AND METHOD OF ASSEMBLING THE SHELF ASSEMBLY IN A LOCKER

(71) Applicants: Thomas Moritz, Kendall Park, NJ (US); Ian Moritz, Kendall Park, NJ (US)

(72) Inventors: Thomas Moritz, Kendall Park, NJ (US); Ian Moritz, Kendall Park, NJ (US)

( * ) Notice: Subject to any disclaimer, the term of this patent is extended or adjusted under 35 U.S.C. 154(b) by 0 days.

(21) Appl. No.: 14/078,683

(22) Filed: Nov. 13, 2013

(65) Prior Publication Data

US 2014/0138338 A1 May 22, 2014

Related U.S. Application Data

(63) Continuation-in-part of application No. 13/066,513, filed on Apr. 15, 2011, now abandoned, which is a continuation-in-part of application No. 12/386,066, filed on Apr. 14, 2009, now abandoned.

(51) Int. Cl.

| | |
|---|---|
| ***A47B 47/00*** | (2006.01) |
| ***A47B 47/04*** | (2006.01) |
| ***A47B 61/00*** | (2006.01) |

(52) U.S. Cl.

CPC ..... *A47B 47/0091* (2013.01); *A47B 47/042* (2013.01); *A47B 61/00* (2013.01); *Y10T 29/49826* (2015.01)

(58) Field of Classification Search

CPC ... A47B 47/0091; A47B 47/042; A47B 61/00
USPC ..... 211/87.01, 90.01, 134, 186; 312/257, 312/245, 263, 264, 351, 107, 108; 248/135; 108/65, 69, 83, 89, 102, 147, 193
See application file for complete search history.

(56) References Cited

U.S. PATENT DOCUMENTS

| | | | | | |
|---|---|---|---|---|---|
| 1,654,409 | A | * | 12/1927 | Browne | 108/29 |
| 2,193,372 | A | * | 3/1940 | Miller | 312/242 |
| 2,360,452 | A | * | 10/1944 | Stone | 312/259 |
| 2,529,649 | A | * | 11/1950 | Coplen | 108/190 |
| 3,326,149 | A | * | 6/1967 | Mitchell et al. | 108/60 |
| 3,567,300 | A | * | 3/1971 | Mari | 312/257.1 |
| 4,153,311 | A | * | 5/1979 | Takahashi | 312/107 |
| 4,236,460 | A | * | 12/1980 | Poupko | 108/41 |
| 4,283,099 | A | * | 8/1981 | Burton | 312/351 |
| 4,793,664 | A | * | 12/1988 | Jackson | 312/306 |
| 5,138,956 | A | * | 8/1992 | Rushbrook et al. | 108/107 |
| 5,295,596 | A | * | 3/1994 | Squitieri | 211/175 |
| 5,454,331 | A | * | 10/1995 | Green | 108/180 |
| 5,746,331 | A | * | 5/1998 | Kurtis | 211/149 |
| 5,941,183 | A | * | 8/1999 | Ming-Shun | 108/153.1 |
| 6,085,668 | A | * | 7/2000 | Kanki | 108/65 |

(Continued)

*Primary Examiner* — Patrick Hawn
(74) *Attorney, Agent, or Firm* — Fox Rothschild LLP

(57) ABSTRACT

A method for constructing a shelf assembly in a locker comprising the steps of: inserting a first sidewall having a transverse slot between upper and lower ends of the sidewall and an inner shoulder at the upper end of the sidewall in the locker against a sidewall of the locker; inserting a second sidewall having a transverse slot located between the upper and lower ends of the sidewall in the locker higher than the first sidewall and holding the second sidewall at that higher position while a first shelf is inserted at an angle with side edges of the shelf generally aligned with the slots; lowering the second sidewall and the first shelf with the side edges engaged in the slots; and, once the lower ends of the sidewalls are firmly supported on a bottom of the locker, inserting the second shelf on the shoulders of the sidewalls.

12 Claims, 12 Drawing Sheets

(56) References Cited

U.S. PATENT DOCUMENTS

| | | | | |
|---|---|---|---|---|
| 6,763,958 | B2 * | 7/2004 | Gervasi | 211/153 |
| 6,854,402 | B2 * | 2/2005 | DuBarry et al. | 108/146 |
| 6,907,829 | B2 * | 6/2005 | Bambach et al. | 108/65 |
| 7,645,001 | B2 * | 1/2010 | Harris | 312/205 |
| 2003/0066813 | A1 * | 4/2003 | Taylor | 211/186 |
| 2004/0159622 | A1 * | 8/2004 | Craft et al. | 211/153 |
| 2004/0164655 | A1 * | 8/2004 | Wood et al. | 312/205 |
| 2007/0284974 | A1 * | 12/2007 | Buhrman | 312/108 |
| 2008/0042532 | A1 * | 2/2008 | Crabtree | 312/257.1 |
| 2009/0057255 | A1 * | 3/2009 | Choi | 211/190 |

* cited by examiner

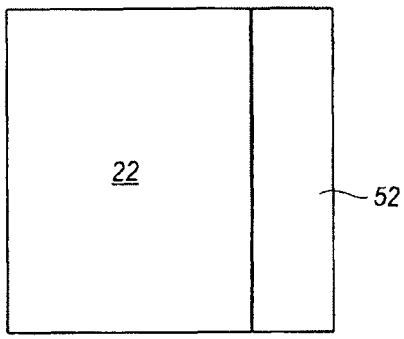
FIG. 5
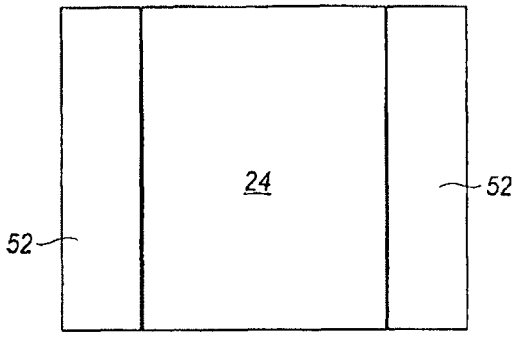
FIG. 6
FIG. 7
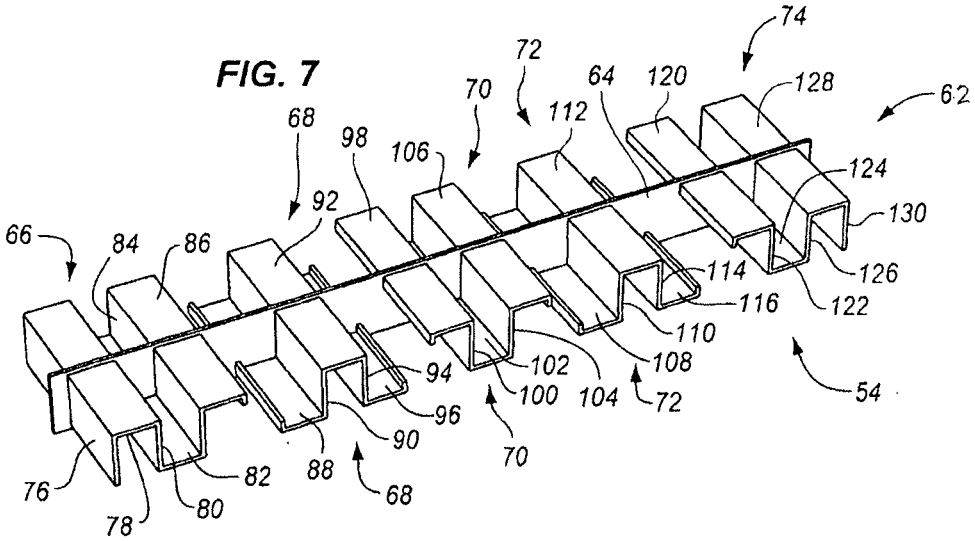
FIG. 8
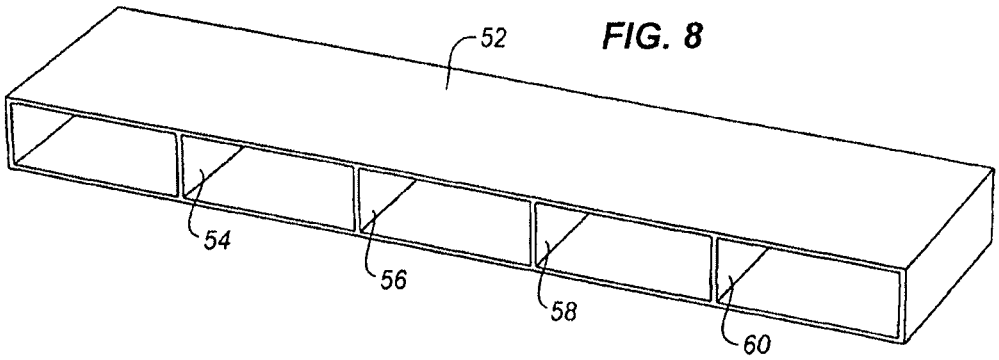

LOCKER SHELF ASSEMBLY KIT WITH EXTENSION SHELVES, LOCKER SHELF ASSEMBLY AND METHOD OF ASSEMBLING THE SHELF ASSEMBLY IN A LOCKER

CROSS-REFERENCE TO RELATED APPLICATION

This application is a continuation-in-part of U.S. Ser. No. 13/066,513, filed on Apr. 15, 2011, which is a continuation-in-part of U.S. Ser. No. 12/386,066, filed on Apr. 14, 2009, both of which are incorporated herein by reference.

FIELD OF THE INVENTION

The present invention relates to a simple shelf assembly which is assembled inside a student's locker at a high school, college or military base, etc. More specifically, the present invention relates to a modular shelf assembly including two sidewall portions and two shelf portions which may be modularly assembled.

BACKGROUND OF THE INVENTION

Heretofore, various shelf assemblies have been proposed for placement in a student's locker. Examples of these prior art shelf assemblies are disclosed in the following U.S. Patents and application:

U.S. Pat. No. 4,500,146 to Richard R. Peterson; U.S. Pat. No. 4,808,875 to John C. Edwards; U.S. Pat. No. 4,818,044 to Bradley M. Dobry; U.S. Pat. No. 5,137,160 to Donald C. Santucci; U.S. Pat. No. 5,221,013 to Donald C. Santucci; U.S. Pat. No. 5,251,973 to Syd Hazan; U.S. Pat. No. 5,421,646 to McNamara et al.; U.S. Pat. No. 5,474,192 to Dane E. Hartzell; U.S. Pat. No. 5,671,990 to Mark Teasdale; U.S. Pat. No. 6,814,418 to Ronald D'orso; U.S. Pat. No. 6,877,826 to Wood et al.; and U.S. Pat. No. D522,284 to Shapiro et al.

SUMMARY OF THE INVENTION

According to the teachings of the present invention, there is provided a method for constructing a shelf assembly in a locker having on each side thereof a generally vertically extending longitudinal lip, the lip on one side of the locker hingedly mounting a locker door, the method comprising the steps of: providing a first sidewall having in an inner sidewall surface thereof a transverse slot located generally midway between upper and lower ends of the sidewall and an inner shoulder at the upper end of the sidewall and a second sidewall having in an inner sidewall surface thereof a transverse slot located generally midway between the upper and lower ends of the sidewall and an inner shoulder at the upper end of the sidewall a first shelf and a second shelf; inserting the first sidewalls in the locker against a sidewall of the locker; inserting the second sidewall in the locker higher than the first sidewall and holding the second sidewall at that higher position while the first shelf is inserted at an angle but with side edges of the shelf generally aligned with the slots lowering the second sidewall and the first shelf with the side edges of the shelf engaging in the slots; and once the lower ends of the sidewalls are firmly supported on a bottom of the locker, inserting the second shelf on the shoulders of the sidewalls.

Further according to the teachings of the present invention there is provided a locker shelf assembly kit comprising first and second sidewalls, each having in an inner-wall surface thereof a transverse slot extending across the sidewall midway between the top and bottom thereof and an inner shoulder at the upper edge of each sidewall and first and second shelves dimensioned to be received either on the transverse grooves or on top of the inner shoulders at the top of each sidewall for forming shelves and being supported by each sidewall.

Additionally according to the teachings of the present invention there is provided a locker shelf assembly constructed inside a locker behind generally vertically extending longitudinal front lips thereof on each side of the locker, the locker shelf assembly comprising first and second sidewalls, each having in an inner wall surface thereof a transverse slot extending across the sidewall and an inner shoulder at the upper end of each sidewall and a first shelf adapted to be received within the slots of the sidewalls and a second shelf adapted to be received on and supported by the inner shoulders at the top of the sidewalls and with the sidewalls of the locker providing side support for the locker shelf assembly and the bottom wall of the locker providing vertical support for the locker shelf assembly.

Also provided are specially constructed shelf extension members for creating 12 inch or 15 inch wide shelves. Each shelf extension member is mounted with a connector framework to an upper or lower shelf.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings:

FIG. 5 is a plan view of a 3 inch shelf extension added to a lower or upper shelf to create a 12 inch shelf.

FIG. 6 is a plan view of two 3 inch shelf extensions added to a lower or upper shelf to create a 12 inch shelf.

FIG. 7 is a perspective view of a connector framework which is used to mount the shelf extensions to a shelf.

FIG. 8 is a perspective view of a shelf extension member.

DETAILED DESCRIPTION OF THE INVENTION

Figure 1:
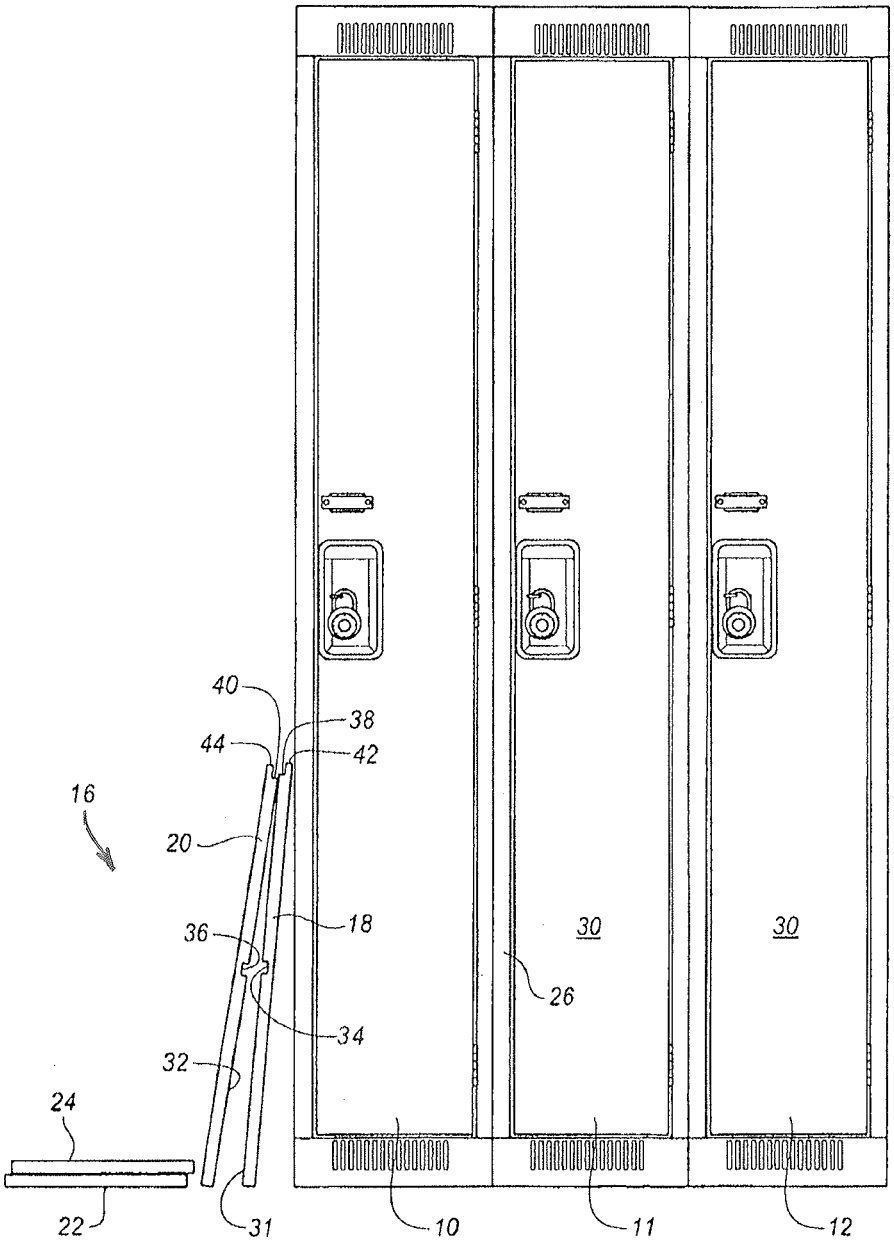
FIG. 1 is an elevational view of three lockers with an un-assembled shelf assembly of the present invention comprising 4 pieces situated adjacent one of the lockers.

In the drawings, like numerals indicate like elements throughout. Certain terminology is used herein for convenience only and is not to be taken as a limitation on the present invention. The following describes preferred embodiments of the present invention. However, it should be understood, based on this disclosure, that the invention is not limited by the preferred embodiments described herein.

Referring now to FIG. 1 there is illustrated therein a set of three lockers 10, 11 and 12 in a locker room in a school hallway, and adjacent the left locker is the un-assembled shelf locker assembly 16 or locker shelf assembly kit of the present invention, which comprises a first sidewall 18, a second sidewall 20, a first lower shelf 22 and a second upper shelf 24.

It is to be noted that each of the lockers has a generally vertically extending longitudinal lip 26, 28 on each side of the locker and a locker door 30 is hingedly mounted to the lip 28.

As will be described below the locker shelf assembly is assembled in a locker from a locker shelf assembly kit comprising the first and second sidewalls 18 and 20, each having in an inner-wall surface 31, 32 thereof a transverse slot 34, 36 extending across the sidewall generally midway between the top and bottom thereof and an inner shoulder 38, 40 at an upper end 42, 44 of each sidewall 18, 20 and the first and second shelves 22, 24 dimensioned to be received either in the transverse slots 34, 36 or on top of the inner shoulders 38, 40 at the top of each sidewall 18, 20 for forming shelves and being supported by each sidewall 18, 20.

In one preferred embodiment the slot 34, 36 in each sidewall 18, 20 has a thickness of approximately 0.75 inch, each slot has a width of approximately 0.75 inch and each shelf has a thickness of approximately 0.75 inch.

Further in this embodiment, the sidewalls 18, 20 have a length of approximately 25.4 inches and a depth of approximately 10 inches into the locker and each shelf 22, 24 has a width of approximately 8 inches and a depth of approximately 10 inches.

Additionally at least side edges of the first shelf 22 are beveled or rounded to facilitate entry of said side edges into said slots. For simplifying manufacture of the parts of the shelf assembly, both shelves 22, 24 can have beveled or rounded side edges although flat side edges also will fit into the slots 34, 36.

Still further in this embodiment the distance from the bottom of each sidewall 18, 20 to the slot 34, 36 is 13 inches and the distance from the slot 34, 36 to the shoulder 38, 40 is 11.5 inches.

The dimensions of the walls and shelves will vary depending on the dimensions of the locker.

Figure 2:
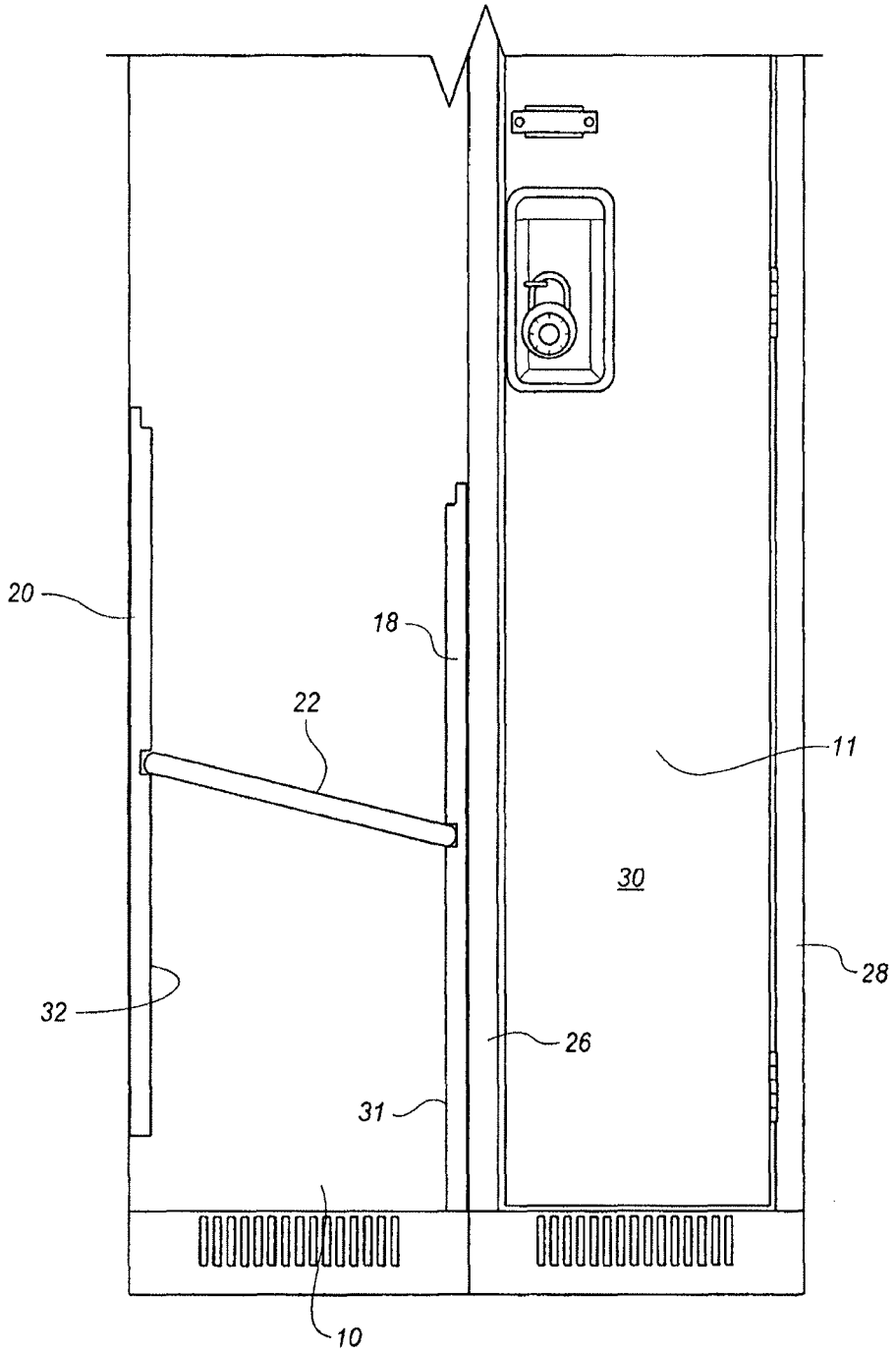
FIG. 2. is a front elevational view of an open locker with generally vertically extending longitudinal lips at the side edges of the open locker omitted and the front door of the locker omitted and shows two sidewalls of the shelf assembly positioned in the locker adjacent sidewalls of the locker while being supported by a bottom of the locker with a lower shelf being inserted into position between the two sidewalls.

Referring now to FIG. 2 there is illustrated therein an open locker 10 with the generally vertically extending longitudinal lips 26, 28 omitted for clarity and the locker door 30 omitted for clarity.

It will be appreciated that the first sidewall 18 is first inserted into the open locker 10. Then the second sidewall 20 is inserted at a higher position to the first sidewall 18 and the first lower shelf 22 is inserted at an angle with the side edges of the first shelf aligned with the slots 34, 36. The second sidewall 20 is then lowered with side edges of the first shelf 22 engaging in the slots 34, 36 until both sidewalls 18, 20 are firmly supported on the bottom of the locker. Then the second shelf 36 is positioned on the inner shoulders 38, 40. In this way, a shelf assembly 50 is constructed within the locker 10 notwithstanding the lips 26, 28 which would normally prevent a shelf assembly to be inserted into the locker.

Figure 4:
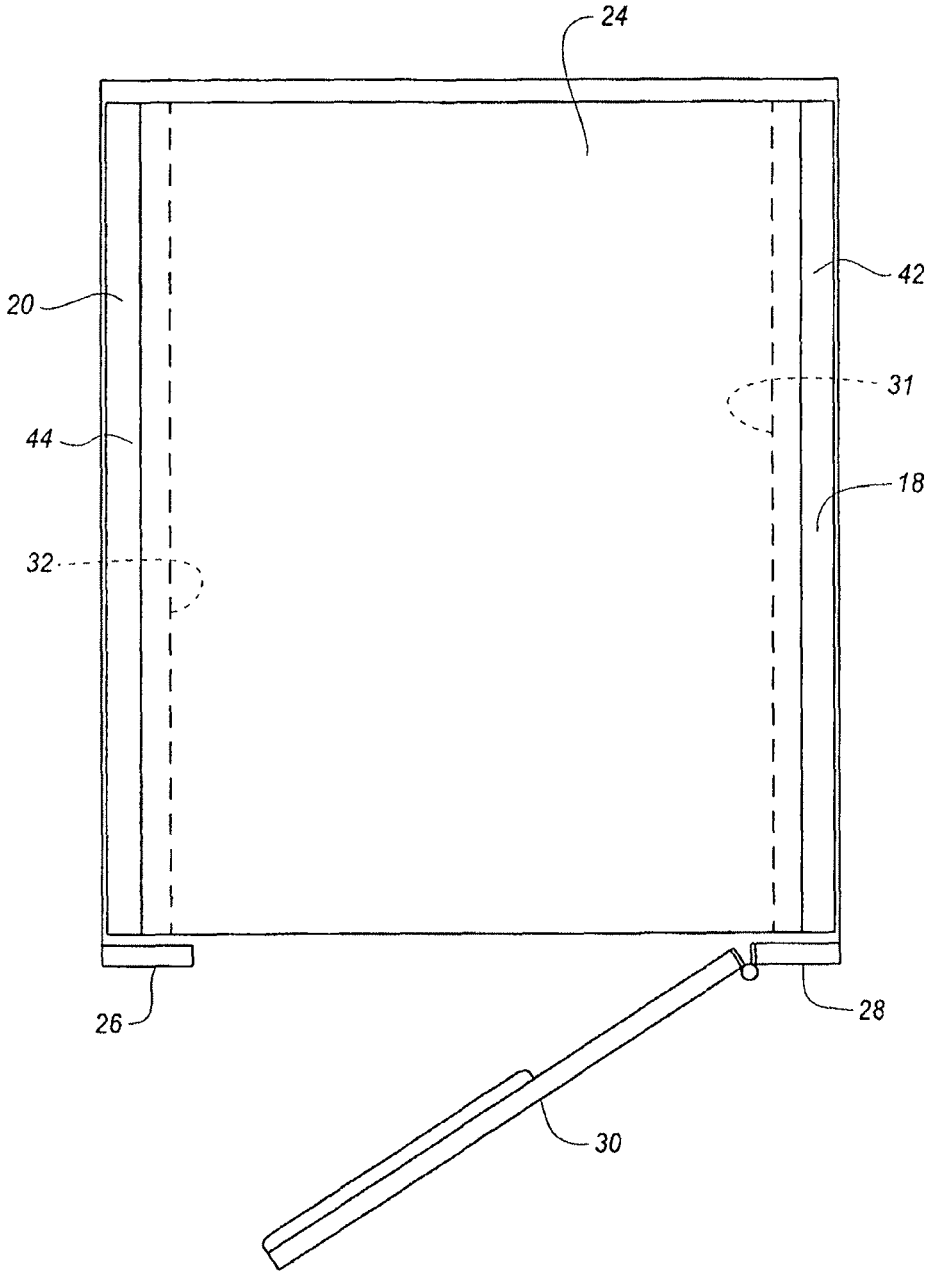
FIG. 4. is a top view of the open locker having the completed shelf assembly therein and showing the vertically extending longitudinal lips of the locker and the locker door partially open.
Figure 9:
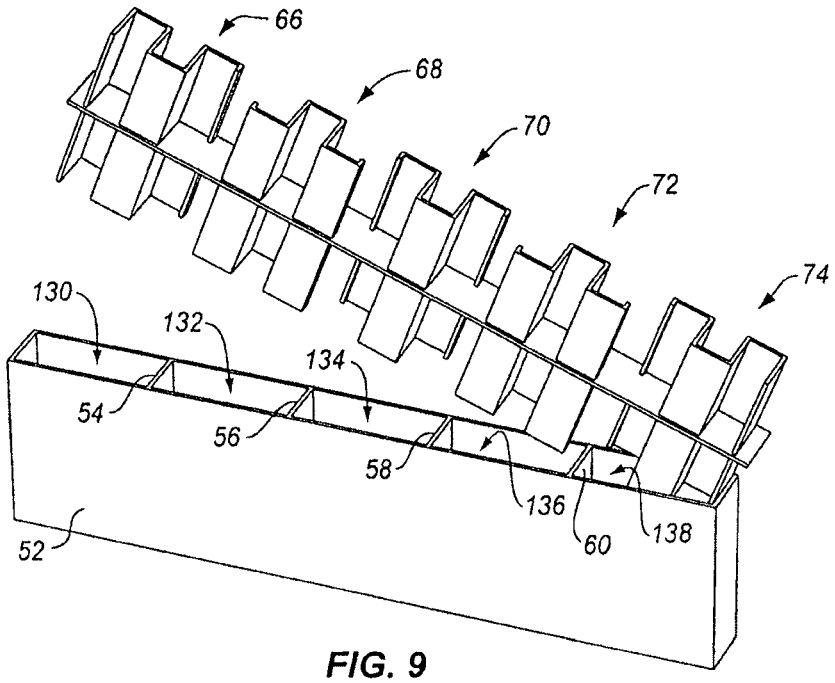
FIG. 9 is a perspective view of a connector framework position at an angle over a shelf extension member.
Figure 10:
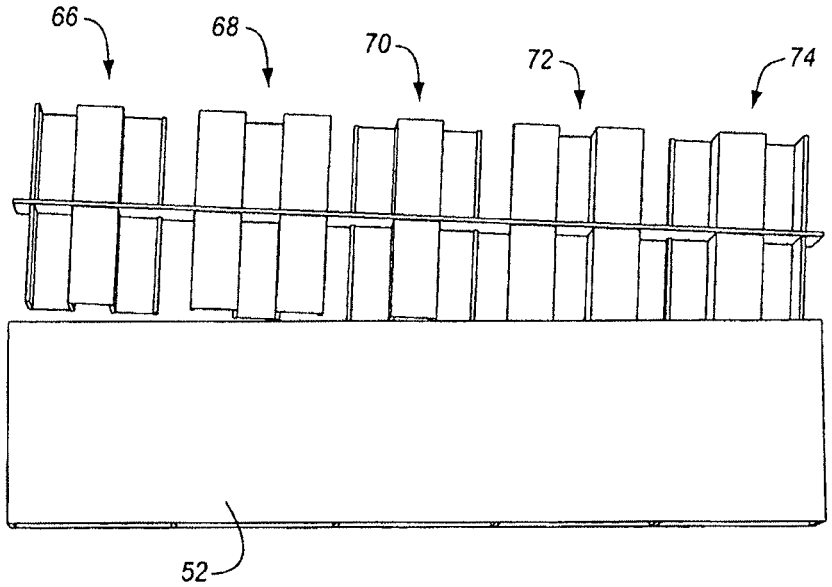
FIG. 10 illustrates a connector framework as it is positioned in a shelf extension member.
Figure 11:
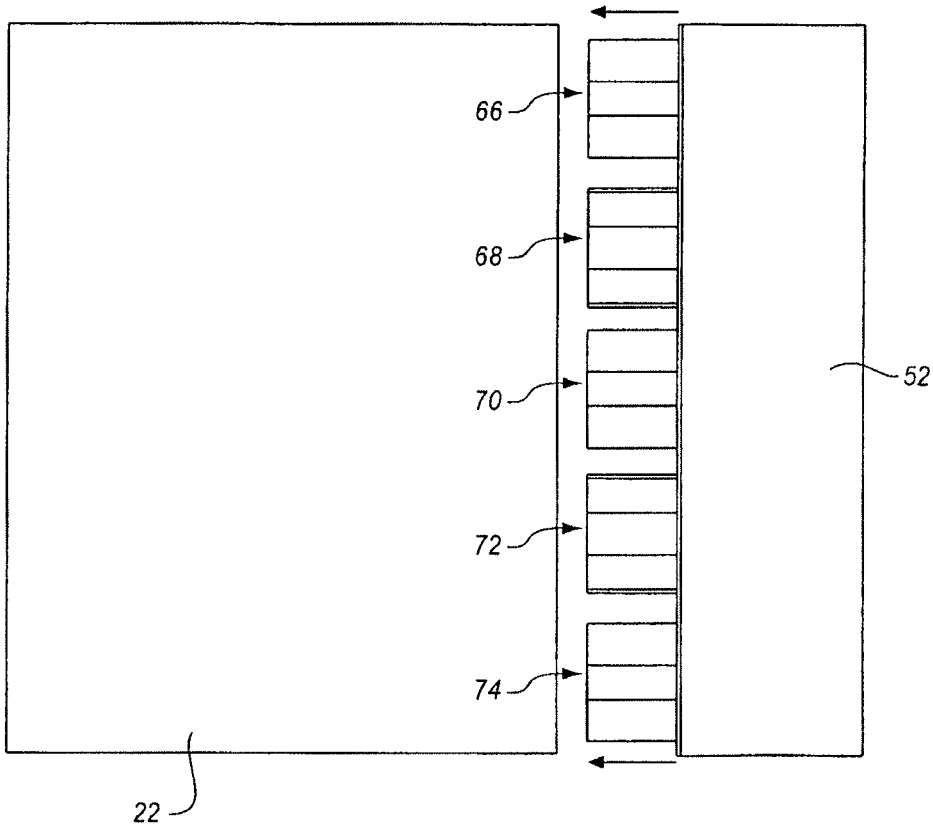
FIG. 11 is a plan view of a shelf extension member and connector framework adjacent a shelf for insertion into the shelf.
Figure 12:
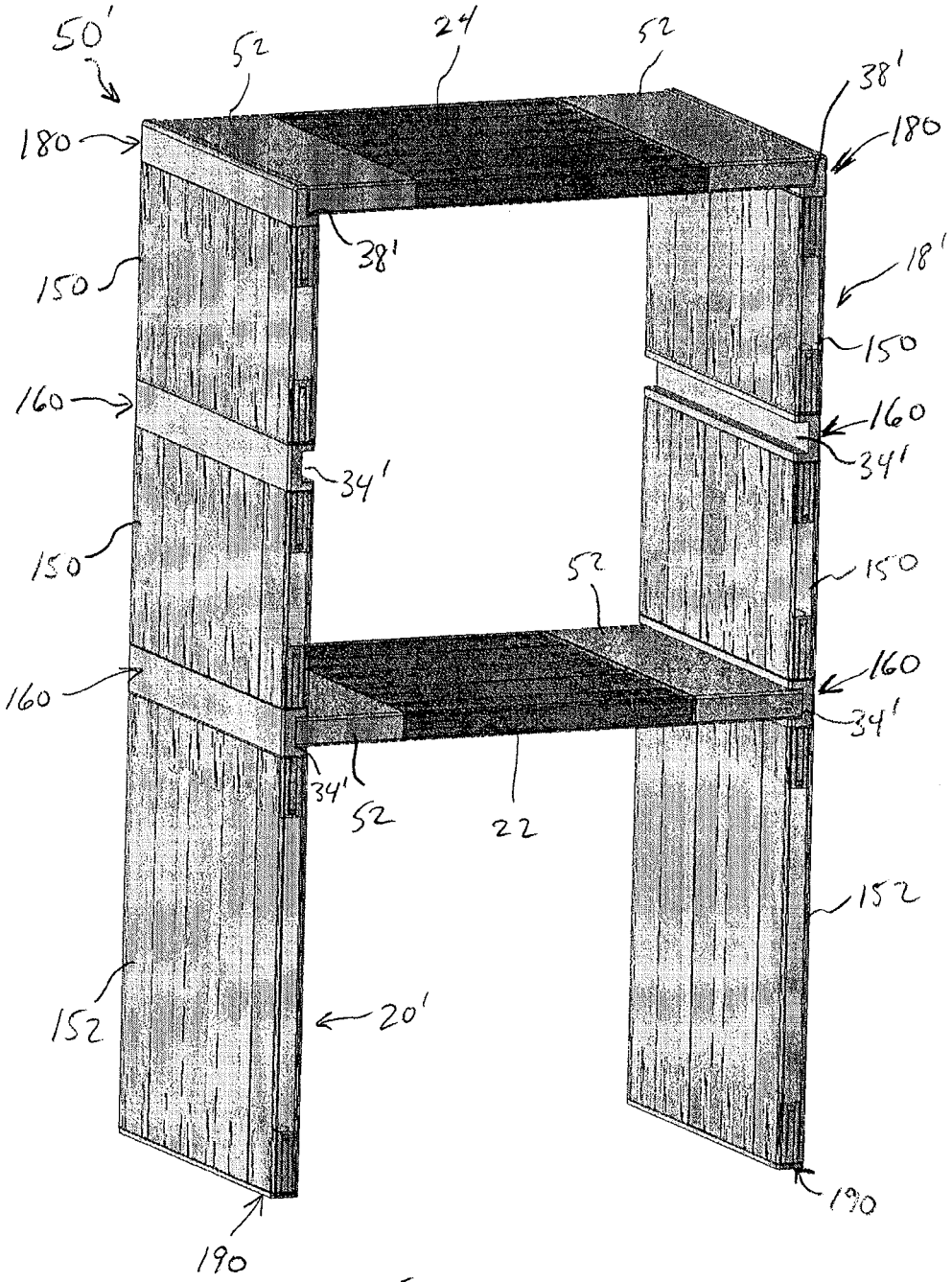
FIG. 12 is a perspective view of an alternative completed shelf assembly.
Figure 13:
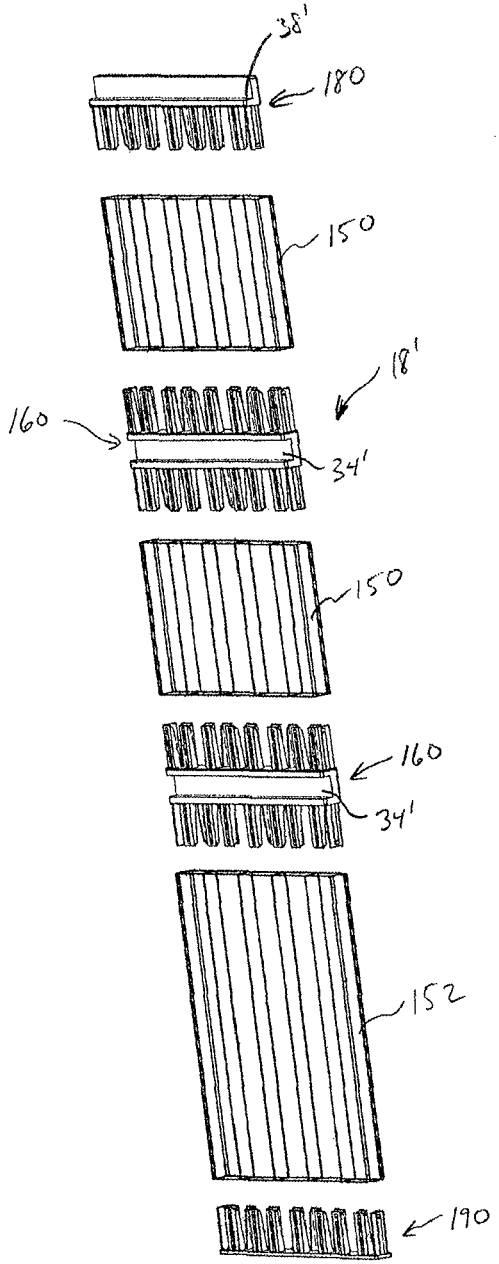
FIG. 13 is an exploded perspective view of an exemplary sidewall of the shelf assembly of FIG. 12.
Figure 15:
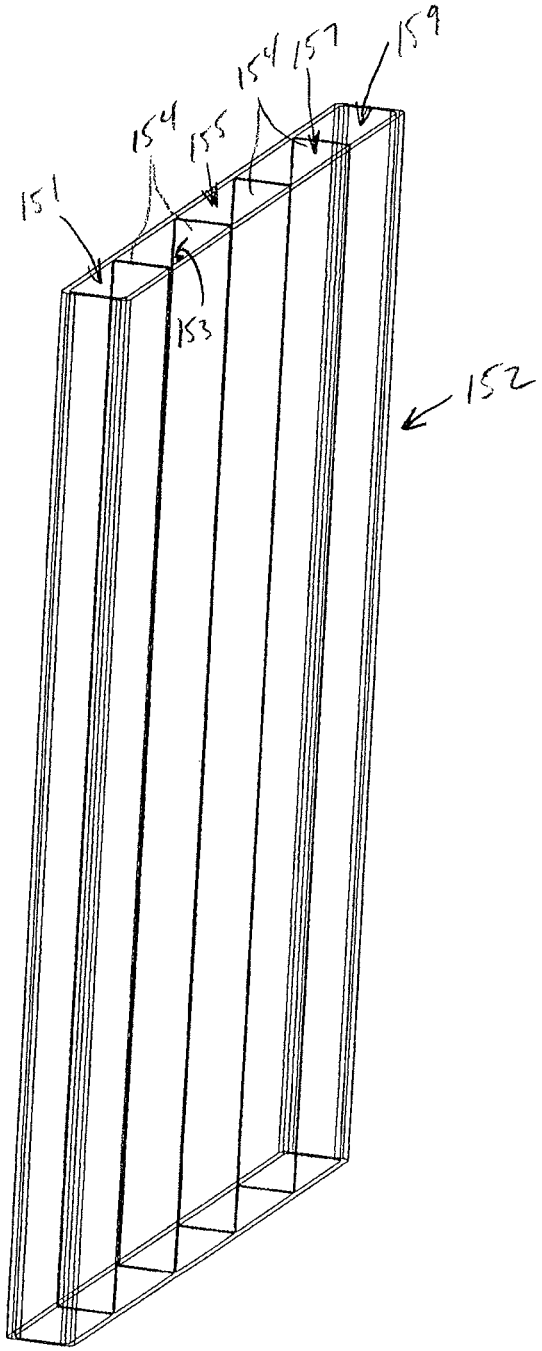
FIGS. 14 and 15 are perspective views of exemplary sidewall panels of the shelf assembly of FIG. 12 shown transparently.
Figure 14:
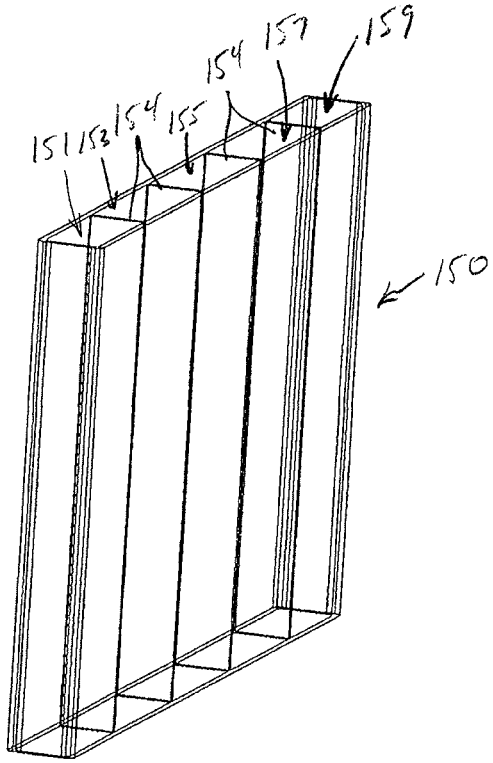

As shown in FIG. 4, the shelf assembly 50 provides upper and lower shelves 22, 24 extending between the two sidewalls 18, 20 of the shelf assembly 50 which press against the sidewalls within the locker. These shelves enable a student to place books on the shelves between classes and enables a student to have more beneficial use of the locker for temporarily storing books and papers.

The locker shelf assembly 50 of the present invention has a number of advantages some of which have been described above and others of which are inherent in the invention. In particular, it enables one to assemble a shelf assembly within a locker rather than inserting a constructed shelf assembly into a locker. This is beneficial because if a shelf assembly was inserted into a locker it would need to be narrower than the edges of the generally vertically extending longitudinal lips 26, 28 of the locker.

Further, the shelf assembly 50 and shelf extension members 52 to be described below of the present invention and the method of constructing same enables construction of the shelf assembly 50 and shelf extension members 52 in the locker with the bottom wall and the sidewalls of the locker supporting the shelf assembly 50 in the locker.

Where the width of the locker is larger than 9 inches, such as for example 12 inches or 15 inches, the upper and lower shelves 22, 24 can be extended with shelf extension members 52 as shown in FIGS. 5-11.

Each shelf extension member 52 is generally hollow with four partition walls 54, 56, 58, and 60 therein.

A connector framework 62 comprising a central elongate plate or center bar 64 has five bridge frames 66, 68, 70, 72 and 74 attached thereto each having a half extending from one side of the center bar 64. This framework 62 is inserted into one half of a shelf extension member 52 and into an upper or lower shelve 22 or 24.

As shown in FIG. 7, the connector framework 62 comprises specially configured bridge frames, 66, 68, 70 72 and 74 mounted on said dividing plate or center bar 64.

Bridge frame 66 comprises an upwardly extending plate 76 connected to a generally top planar plate 78 which is connected to a downwardly extending side plate 80. A bottom plate 82 extends from the side plate 80 to an upwardly extending side plate 84 that extends to a top plate 86.

Bridge frame 68 comprises a first bottom plate 88 that extends to a first upwardly extending side plate 90 that extends to a top plate 92. A second downwardly extending side plate 94 extends downwardly to a second bottom plate 96.

The bridge frame 70 comprises a first top plate 98 connected to a first downwardly extending side plate 100 which extends to a bottom plate 102 that connects to a second upwardly extending side plate 104 that connects to a second top plate 106.

The bridge frame 72 comprises a structure identical with the structure of the bridge frame 68 with a first bottom plate 108, a first upwardly extending side plate 110, a top plate 112, a second downwardly extending side plate 114 and a second bottom plate 116.

Finally, the last bridge frame 74 has an inverse construction to the bridge frame 66 and comprises a top plate 120 connected to a first downwardly extending side plate 122 which is connected to a bottom plate 124 which extends to a second upwardly extending side plate 126 that is connected to a top plate 128 that extends to a third downwardly extending side plate 130.

The bridge frames extend into five compartments 130, 132, 134, 136 and 138 created in the shelf extension member 52 by the four partition walls 54, 56, 58, and 60 therein. The shelf extension member 52 may have more or fewer partition walls defining more or fewer compartments with the connector frames having complementary configurations.

The reinforcing structure of the bridge frames 66, 68, 70 72 and 74 insure that there is sufficient support in the shelf extension members 52.

Figure 3:
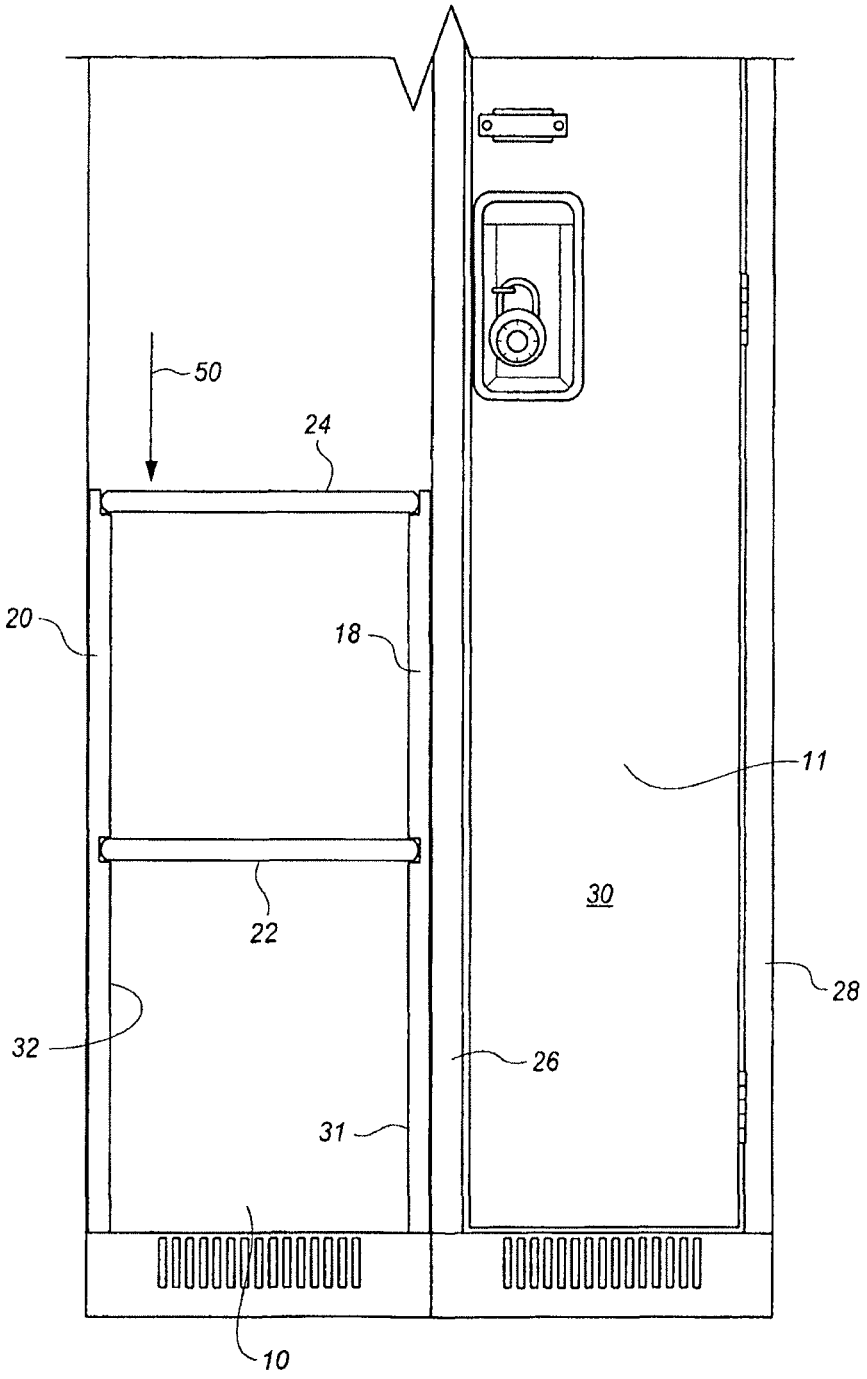
FIG. 3. is a front view of the open locker similar to FIG. 2 with the vertically extending longitudinal lips of the locker omitted and with the door omitted to show the completed assembly of the shelf assembly in the locker.

Referring to FIGS. 12-19, a shelf assembly 50', constructed from a shelf assembly kit as described below, in accordance with another exemplary embodiment of the invention will be described. The shelf assembly 50' includes a first modular sidewall 18', a second modular sidewall 20', a first lower shelf 22 and a second upper shelf 24. The shelves 22, 24 generally have the configuration as described above and may have the continuous configuration illustrated in FIGS. 1-3 or the modular configuration illustrated in FIGS. 5-11. The illustrated shelves 22, 24 have the modular construction with extensions 52.

The modular sidewalls 18', 20' are generally the same and are positioned in opposite orientations such that transverse slots and shoulders thereof face one another. Each modular sidewall 18', 20' includes at least two wall panels 150, 152, at least one channel connector framework 160 and at least one top connector framework 180. The modular sidewalls 18', 20' may also include one or more straight connector frames 62' and/or a bottom connector framework 190. The components may be assembled in various configurations, with the illustrated configuration only an exemplary configuration.

The illustrated modular sidewalls 18', 20' each include a longer sidewall panel 152 with a bottom connector framework 190 connected to one end thereof and a channel connector framework 160 connected to the opposite end. The opposite end of the channel connector framework 160 is connected to a first end of a shorter sidewall panel 150 such that the longer sidewall panel 152 is connected to the shorter wall panel 150 with a transverse slot 34' therebetween. The opposite end of the shorter wall panel 150 is connected to another channel connector framework 160 which is in turn is connected to another shorter wall panel 150 such that the two shorter wall panels 150 are connected to one another with a transverse slot 34' therebetween. The opposite end of the second shorter wall panel 150 has a top connector framework 180 connected thereto with the top connector framework 180 defining a shoulder 38' configured to receive the upper shelf 24. The modular components allow the shelf assembly 50' to have various heights and to have shelves positioned at various heights. While two shelves 22, 24 are illustrated, the shelf assembly 50' may include more than the illustrated two shelves.

The exemplary components will be described in more detail below. The exemplary sidewall panels 150 and 152 will be described with reference to FIGS. 14 and 15. The exemplary sidewall panels 150 and 152 generally have the same configuration except for the differing lengths. In an exemplary embodiment, the shorter sidewall panel 150 has a length of 6 inches and the longer sidewall panel 152 has a length of 12 inches. Each sidewall panel 150, 152 generally has a hollow wall structure. In the exemplary embodiments, four partition walls 154 extend transversely within the hollow wall structure to define five compartments 151, 153, 155, 157 and 159 configured to receive complementary portions of the various connector frames 60', 160, 180 and 190. The sidewall panels 150, 152 may have more or fewer partition walls defining more or fewer compartments with the connector frames having complementary configurations.

Figure 16:
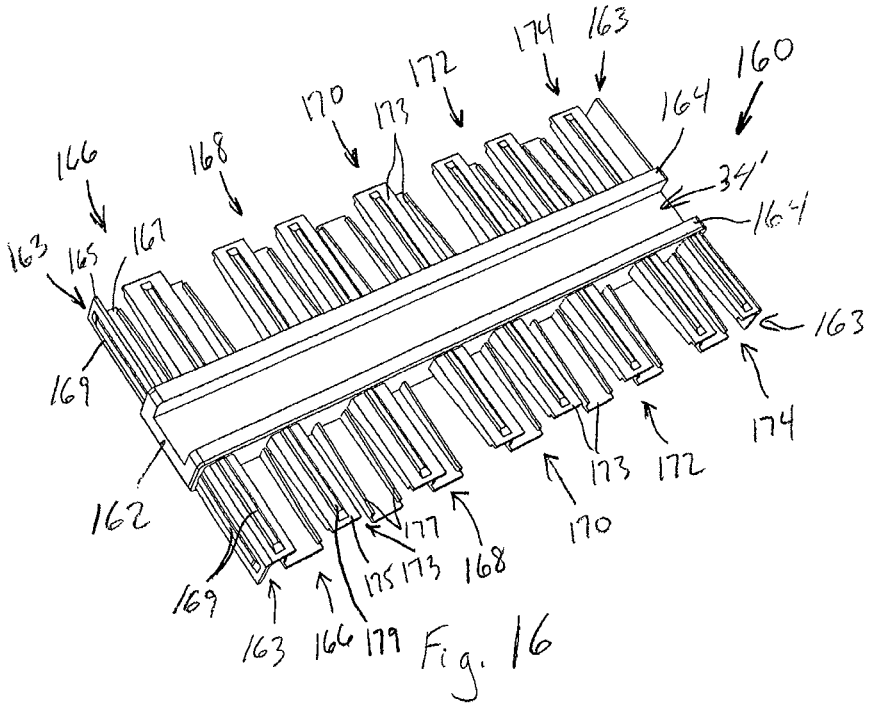
FIG. 16 is a perspective view of an alternative connector framework utilized in the shelf assembly of FIG. 12.

Referring to FIG. 16, an exemplary channel connector framework 160 will be described. The connector framework 160 includes a u-shaped center bar 162 with a transverse slot 34' defined between upper and lower plates 164. The channel connector framework 160 includes five bridge frames 166, 168, 170, 172 and 174 attached thereto with each having a half extending from one side of the upper plate 164 and an opposite half extending from the lower plate 164. As explained above, the number and configuration of the bridge frames is configured to correspond with the compartments of the sidewall panels 150, 152.

In the present embodiment, the bridge frames 166, 168, 170, 172 and 174 are defined by a plurality of tongues including end tongues 163 and center tongues 173. In the illustrated embodiment, each end tongue 163 includes a pair of tongue panels 165, 167 connected perpendicular to one another with each tongue panel 165, 167 having a tapered rib 169 on the outer surface thereof. Each center tongue 173 includes a tongue panel 175 supported by a pair of a pair of inward support ribs 177. A tapered rib 179 may extend along the outside surface of each tongue panel 175. In the illustrated embodiment, the end bridges 166 and 174 are each defined by an end tongue 163 and two adjacent central tongues 173 while the bridges 168, 170 and 172 are each defined by three adjacent central tongues 173. While the tongues are illustrated in the present embodiment, the bridges may have other configurations including those described above with reference to FIG. 7.

Figure 17:
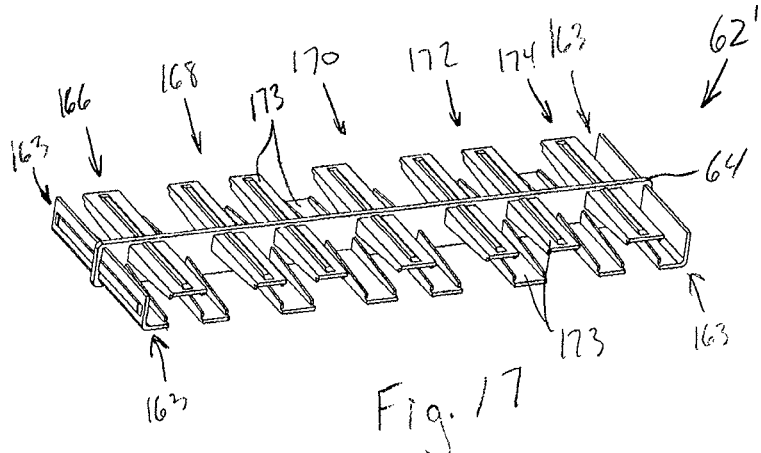
FIG. 17 is a perspective view of a channel connector framework utilized in the shelf assembly of FIG. 12.

Referring to FIG. 17, an alternative straight connector framework 62' is illustrated. Similar to the connector framework 62, the connector framework 62' includes a dividing plate or center bar 64. In the present embodiment, a plurality of bridge frames 166, 168, 170, 172 and 174 similar to those described with respect to FIG. 16 extend from the center bar 64. Such a connector framework 62' may be utilized to connect the shelves 22, 24 to the extensions 52. Additionally, the straight connector frames 62' may be utilized to interconnect sidewall panels 150, 152 when desired to increase the length without including a transverse slot.

Figure 18:
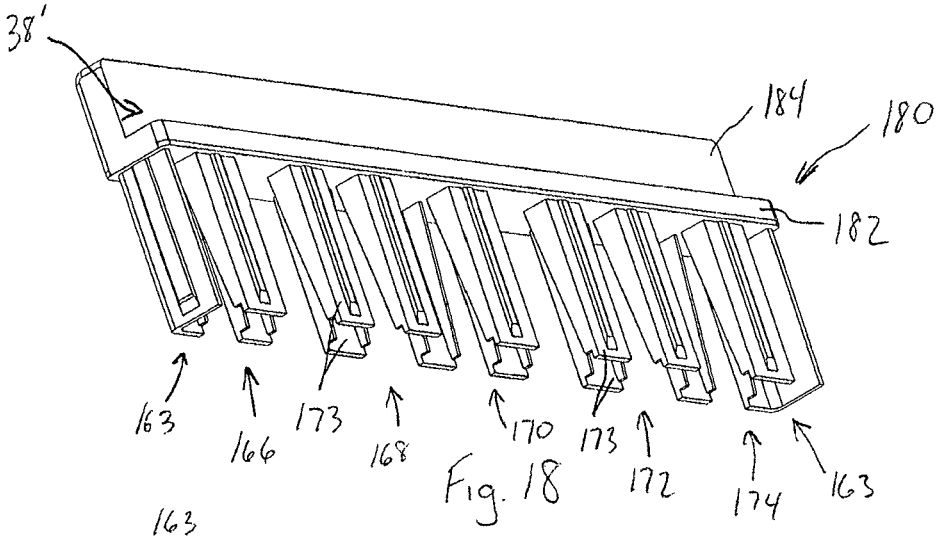
FIG. 18 is a perspective view of a top connector framework utilized in the shelf assembly of FIG. 12.

Referring to FIG. 18, an exemplary top connector framework 180 will be described. The exemplary top connector framework 180 includes a top plate 182 which is configured to close off the top end of the sidewall panel 150, 152 to which the top connector framework 180 is connected. A shoulder plate 184 extends perpendicularly to the top plate 182 and defines the shoulder 38' configured to receive the end of a respective upper shelf 24. The opposite side of the top plate 182 includes a plurality of bridge frames 166, 168, 170, 172 and 174 similar to those described with respect to FIG. 16, configured for connection to the sidewall panel 150, 152.

Figure 19:
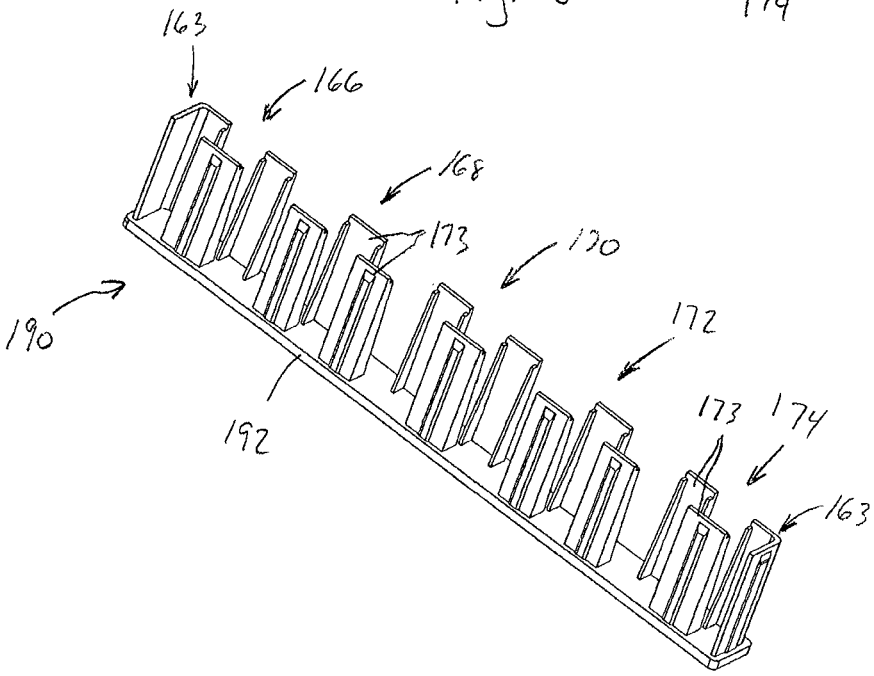
FIG. 19 is a perspective view of a bottom connector framework utilized in the shelf assembly of FIG. 12.

Referring to FIG. 19, an exemplary bottom connector framework 190 will be described. The exemplary bottom connector framework 190 includes a bottom plate 192 which is configured to close off the bottom end of the sidewall panel 150, 152 to which the bottom connector framework 190 is connected. One side of the bottom plate 192 includes a plurality of bridge frames 166, 168, 170, 172 and 174, similar to those described with respect to FIG. 16, configured for connection to the sidewall panel 150, 152.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as defined in the claims.

What is claimed is:

1. A locker shelf assembly comprising:

a first sidewall having an inner-wall surface with at least one first transverse slot extending thereacross;

a second sidewall having an inner-wall surface with at least one second transverse slot extending thereacross, the first and second transverse slots each having a common slot width; and a first shelf extending between opposed first and second ends and having a shelf thickness equal to or less than the slot width;

wherein the first shelf is positioned such that it extends generally horizontally with the first end thereof received in one of the at least one first transverse slots such that the first end is vertically supported by the first transverse slot but otherwise remains unconnected to the first sidewall and the second end thereof is received in one of the at least one second transverse slots such that the second end is vertically supported by the second transverse slot but otherwise remains unconnected to the second sidewall; and a second shelf extending between opposed first and second ends, and wherein the first and second sidewalls each define an inner recessed shoulder at an upper end thereof and the second shelf is positioned such that it extends generally horizontally with the first end thereof received in the inner recessed shoulder of the first sidewall such that the first end is vertically supported by the inner recessed shoulder of the first sidewall but otherwise remains unconnected to the first sidewall and the second end thereof is received in the inner recessed shoulder of the second sidewall such that the second end is vertically supported by the inner recessed shoulder of the second sidewall but otherwise remains unconnected to the second sidewall.

2. The locker shelf assembly according to claim 1 wherein the slot width is approximately 0.75 inch and the shelf thickness is approximately 0.75 inch.

3. The locker shelf assembly according to claim 1 wherein the first and second ends of the first shelf are beveled or rounded.

4. The locker shelf assembly according to claim 1 wherein the first and second shelves are horizontally extendable in length by attaching a shelf extension member to one or both of the first and second ends of the respective shelf.

5. The locker shelf assembly according to claim 1 wherein the first and second sidewalls each comprise at least a first sidewall panel, a second sidewall panel and a first separate connector member which interconnects the first and second sidewall panels together, and wherein the first separate connector member defines the respective transverse slot.

6. In combination, a locker and a locker shelf assembly according to claim 1, wherein said locker includes first and second locker sidewalls and a bottom surface extending between the first and second locker sidewalls, wherein the locker shelf assembly kit is positioned in the locker such that the first and second sidewalls are vertically supported by the bottom surface, and the first sidewall is adjacent to the first locker sidewall and the second sidewall is adjacent the second locker sidewall such that the first and second locker sidewalls prevent the first and second sidewalls from separating horizontally apart a distance greater than a length of the first shelf.

7. The combination according to claim 6 wherein a first vertically extending longitudinal front lip extends along the first locker sidewall and a second vertically extending longitudinal front lip extends along the second locker sidewall such that an opening is defined between the first and second lips, the opening having a width which is less than the length of the first shelf.

8. The combination according to claim 1 wherein the second shelf has a length greater than the width of the opening.

9. A method of assembling a shelf assembly in a locker, the locker having first and second locker sidewalls and a bottom surface extending between the first and second locker sidewalls, said method comprising the steps of:

positioning a first sidewall, having upper and lower ends, in the locker such that the lower end thereof is vertically supported on the bottom surface and an outer surface thereof is adjacent the first locker sidewall, wherein an inner surface of the first sidewall defines a transverse slot extending thereacross between the upper and lower ends and an inner recessed shoulder at the upper end thereof;

positioning a second sidewall, having upper and lower ends, in the locker such that the lower end thereof is spaced from the bottom surface and an outer surface thereof is adjacent the second locker sidewall, wherein an inner surface of the second sidewall defines a transverse slot extending thereacross between the upper and lower ends and an inner recessed shoulder at the upper end thereof;

positioning a first shelf such that a first end therein is received in the transverse slot of the first sidewall and a second end thereof is received in the transverse slot of the second sidewall;

lowering the second sidewall until the lower end thereof is vertically supported by the bottom surface and the first shelf is positioned such that it extends generally horizontally with the first end thereof received in the transverse slot of the first sidewall such that the first end is vertically supported by the transverse slot of the first sidewall but otherwise remains unconnected to the first sidewall and the second end is received in the transverse slot of the second sidewall such that the second end is vertically supported by the transverse slot of the second sidewall but otherwise remains unconnected to the second sidewall, and positioning the second shelf such that it extends generally horizontally with the first end thereof received in the inner recessed shoulder of the first sidewall such that the first end is vertically supported by the inner recessed shoulder of the first sidewall but otherwise remains unconnected to the first sidewall and the second end thereof is received in the inner recessed shoulder of the second sidewall such that the second end is vertically supported by the inner recessed shoulder of the second sidewall but otherwise remains unconnected to the second sidewall;

wherein the first and second locker sidewalls prevent the first and second sidewalls from separating horizontally apart a distance greater than a length of the first shelf.

10. The method according to claim 9 wherein a first vertically extending longitudinal front lip extends along the first locker sidewall and a second vertically extending longitudinal front lip extends along the second locker sidewall such that an opening is defined between the first and second lips, the opening having a width which is less than the length of the first shelf wherein the first and second sidewalls are positioned behind the first and second lips respectively.

11. The method according to claim 9 wherein the second shelf has a length greater than the width of the opening.

12. The method according to claim 9 wherein prior to the step of positioning the first sidewall, the method includes the step of assembling the first sidewall by positioning a first connector member, the first connector member defining the respective transverse slot, such that the first connector member interconnects a first sidewall panel and a second sidewall panel, and prior to the step of positioning the second sidewall, the method includes the step of assembling the second sidewall by positioning a second connector member, the second connector member defining the respective transverse slot, such that the second connector member interconnects a third sidewall panel and a fourth sidewall panel.

* * * * *